US006816068B2

(12) United States Patent
McCuen et al.

(10) Patent No.: US 6,816,068 B2
(45) Date of Patent: Nov. 9, 2004

(54) PROGRAMMABLE TEMPORAL CODES/ PULSES

(75) Inventors: Steven W. McCuen, Saratoga, CA (US); Dominick A. Testa, St. Charles, IL (US)

(73) Assignee: Honeywell International, Inc., Morristown, NJ (US)

( * ) Notice: Subject to any disclaimer, the term of this patent is extended or adjusted under 35 U.S.C. 154(b) by 430 days.

(21) Appl. No.: 09/991,256

(22) Filed: Nov. 14, 2001

(65) Prior Publication Data

US 2003/0090385 A1 May 15, 2003

(51) Int. Cl.[7] ..... G08B 29/00

(52) U.S. Cl. ..... 340/506; 340/507; 340/508; 340/531; 340/533; 340/3.1

(58) Field of Search ..... 340/506, 507, 340/508, 511, 514, 531, 533, 534, 3.1

(56) References Cited

U.S. PATENT DOCUMENTS

| | | | | |
|---|---|---|---|---|
| 4,262,286 A | | 4/1981 | Tanigawa | |
| 4,274,084 A | | 6/1981 | Haus | |
| 4,540,890 A | | 9/1985 | Gangemi et al. | |
| 4,555,695 A | | 11/1985 | Machida et al. | |
| 4,785,195 A | | 11/1988 | Rochelle et al. | |
| 5,400,246 A | | 3/1995 | Wilson et al. | |
| 5,525,962 A | | 6/1996 | Tice | |
| 5,559,492 A | | 9/1996 | Stewart | |
| 5,596,568 A | * | 1/1997 | Fleshren | 370/249 |
| 5,598,139 A | | 1/1997 | Karim et al. | |
| 5,608,375 A | | 3/1997 | Kosich | |
| 5,659,287 A | | 8/1997 | Donati et al. | |
| 5,751,210 A | | 5/1998 | Kosich | |
| 5,783,989 A | * | 7/1998 | Issa et al. | 340/426.25 |
| 5,883,573 A | * | 3/1999 | Mazeiko et al. | 340/506 |
| 5,959,528 A | | 9/1999 | Right et al. | |
| 6,049,446 A | * | 4/2000 | Ha et al. | 361/58 |
| 6,097,288 A | * | 8/2000 | Koeppe, Jr. | 340/517 |
| 6,281,789 B1 | | 8/2001 | Furtado et al. | |
| 6,462,654 B1 | | 10/2002 | Sandelman et al. | |

OTHER PUBLICATIONS

Wheelock Inc., Fire Alarm Systems, Series AMT and AMT Strobe Multitone Electronic Appliances for New York City, Copyright 1998, MEA 151–92–E, vol. 21.

Notification of Transmittal of the International Search Report or the Declaration mailed Apr. 28, 2003 for counterpart PCT/US01/34460 application of the above identified application.

* cited by examiner

*Primary Examiner*—Daryl Pope
(74) *Attorney, Agent, or Firm*—Welsh & Katz, Ltd.

(57) ABSTRACT

A software driven, audible output control module can carry out bi-directional communications with an alarm system using the same common link as is used by ambient condition detectors, such as smoke or gas detectors. The audible control module can store characteristics of a plurality of predetermined outputs. The system control can download an audible output originating command. Alternately, such information from detectors can be directly read off the link by the respective modules.

39 Claims, 3 Drawing Sheets

PROGRAMMABLE TEMPORAL CODES/ PULSES

FIELD OF THE INVENTION

The invention pertains to control units for audible output devices in alarm systems. More particularly, the invention pertains to software driven control units which can provide a plurality of different audible outputs.

BACKGROUND OF THE INVENTION

Known fire alarm systems usually indicate alarm conditions to building occupants via two methods: audible and visual. In many known systems, audible output is typically provided by sounder modules connected to fire alarm outputs.

The sounder modules provide fixed tone sequences selected by hardware methods. The sounder modules can only produce the preselected tone sequence when the fire alarm output turns it on.

Often two distinct tone sequences are required. For example, a slow tone for alert signaling and a fast tone for evacuation signaling. A common audible output signal for fire alarm systems is the temporal code. This code consists of a sound pattern of one second on followed by one second off, repeated continuously. Temporal audible coding is commonly used as an evacuation signal.

Hardware based sounders can be configured to produce the noted temporal code but they can not be reconfigured dynamically based on system conditions. A traditional fire alarm control module provides a simple on-off control to a sounder that produces the audible output for which it was configured.

FIG. 1 illustrates a prior art, hardware based sounder control configuration. In a system 10, as illustrated in FIG. 1, first and second control modules 12*a*, 12*b* are coupled to a common system, communication bus or link 14. Bus 14 could be dedicated to audible and/or visible output devices. Alternately, it could be the same bus to which system ambient condition detectors are coupled.

Each of modules 12*a*, 12*b* is hardware configured to respond to a different condition such as a fire alert or an evacuation. An output from each module 12*a, b* is coupled to a different input port of a multiple input sounder module 16. The sounder module 16 will be activated to produce the pre-selected audible output in response to a signal at a selected input from respective module 12*a, b*. In this implementation, the sounder module 16 includes multi-port input circuitry which responds to a common form of control signals, coupled to different ports, to drive the sounder in different ways to produce different audible outputs. The sounder 16 thus produces different drive signals, analog waveforms or digital pulses which in turn drive the output transducer.

In other known systems, the alarm system control unit, or, panel can provide a broader range of audible outputs by transmitting, on a loop basis, control pulses to the audible output devices. Such systems directly control the audible output devices, via local control circuitry by modulated pulse sequences transmitted on loops that are dedicated to those output devices.

There continues to be a need for more flexible control circuits for driving audible output devices. It would be desirable to be able to mix sensor modules, or detectors, with such control circuits on a common communications link.

Preferably, the control circuits would be transparent to the common communications link.

SUMMARY OF THE INVENTION

In accordance with the invention, traditional audible output control in an alarm system is improved upon by placing the output sequencing under software control. This allows the respective alarm system to dynamically select the type of audible output as required. The system could be configured to produce an alert tone or an evacuation tone depending on conditions. Other output tones or visual outputs could also be produced.

In one aspect, an alarm system includes software driven, flexible audible signaling. An output module is coupled to a sound generating device such as a mechanical or electronic horn or a visual output device. The output module can be programmed to turn the drive to the output device with selected signals on and off in a particular sequence. This sequence produces a distinct audible pattern from the horn or a distinct visual sequence.

An advantage of a system in accordance with the invention is that the output generating signals can be coupled to relatively inexpensive output devices which do not have complex input circuits for providing various outputs. The software driven output modules can directly produce a plurality of different signals which can be coupled to the respective output devices, such as mechanical or electronic horns, to produce a plurality of different audible outputs. The output devices are thus simpler and less expensive.

A software driven output control module provides a programmable output signal. This output module is configured by downloading one or more control parameters from an alarm control unit or panel. Sets of parameters can include multiple audible or visible output signal sequences and the event controls to activate the sequences.

The audible or visual output sequence appropriate for any given system event could then be produced as needed. The control program for the respective module would select the appropriate output signal from those available in the module. The downloadable control parameter(s) for one or more output signals can be defined in various ways.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
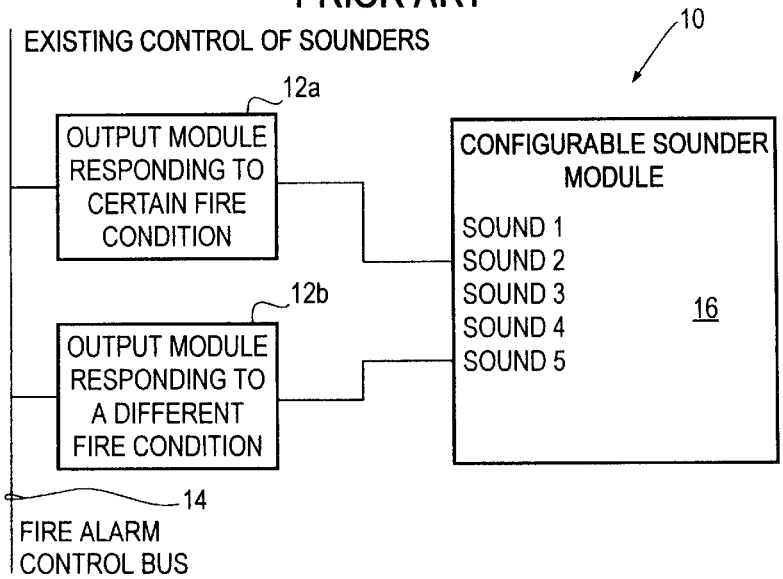
Fig. 1 PRIOR ART
FIG. 1 is a block diagram of a prior art system.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Figure 2:
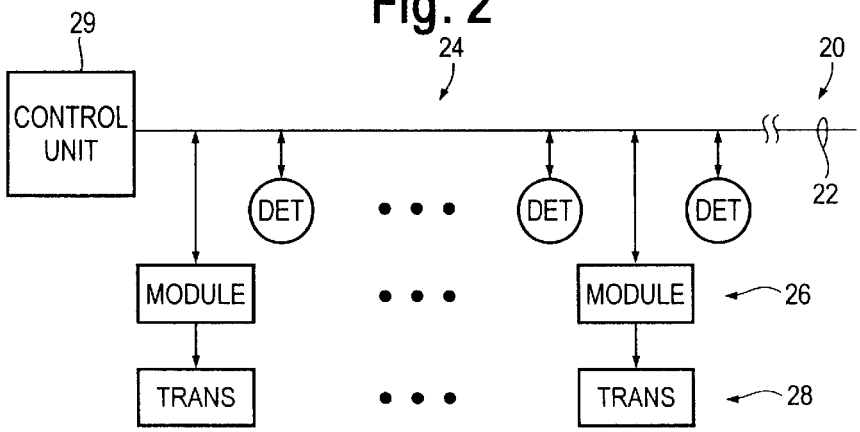
FIG. 2 is a block diagram of an alarm system in accordance with the present invention.

FIG. 2 illustrates a system 20 in accordance with the present invention. The system 20 incorporates a common communication link, such as an electrical cable 22, which could incorporate a plurality of conductors as would be understood by those of skill in the art. In the system 20, a plurality of ambient condition detectors 24 is coupled to and in bi-directional communication with the link 22.

It will be understood that the members of the plurality 24 could incorporate various ambient condition sensors and a variety of different control circuitry, as would be understood by those of skill in the art, without departing from the scope and spirit of the present invention. These could include one or more fire, smoke, gas or intrusion sensors without limitation A plurality of substantially identical control modules 26 is also coupled to the control link 22. Members of the plurality 26 are in turn coupled to members of a plurality 28 of audible and/or visual output transducers. Representative transducers include audio range speakers, sirens, bells, horns, such as piezo-electric horns and the like. The plurality 28 can include other unennumerated audible devices, including voice annunciators of a type used to indicate alarm conditions, as well as visual alarm indicators such as strobe lights or other visual indicators.

The members of the plurality of control modules 26 which are in turn connected to respective members of the plurality 28 provide electrical signals of a type that can be used to drive the respective output device in accordance with a pre-stored parameter, set of parameters or other characteristics which identify desired audible outputs. For example, speakers can be used to produce specified alarm indicating or warning tones. Horns can produce a plurality of different types of tonal outputs depending on the characteristics of the electrical signals used to drive same. Strobes can be flashed at varying rates. Additionally, the drive signals can be presented intermittently so as to provide silent intervals between one or more outputs.

As discussed in more detail subsequently, the detectors 24 can be located in a plurality of regions to be monitored. The modules, members of plurality 26 along with respective transducers, members of plurality 28, can be located in the regions of interest.

The modules 26 can incorporate one or more sets of pre-stored output defining parameters as well as event-identifiers. When the existence of a selected event has been recognized, the respective module can in turn use one or more of the pre-stored parameter or parameters to produce an appropriate electrical output to drive the respective transducer. For example, parameters defining a plurality of audible outputs such as pre-alarm tones, alarm tones, evacuation tones or the like can be stored in one or more of the modules 26. One or more event-identifiers can be stored and associated with each of the various output defining parameters or information.

Figure 3:
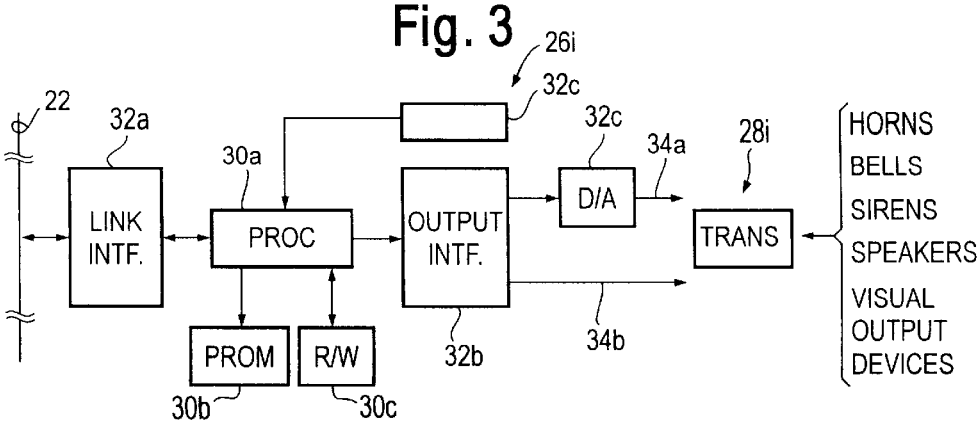
FIG. 3 is a block diagram of a control module usable in the system of FIG. 2.

FIG. 3 illustrates a block diagram of a representative module 26*i* which is in turn coupled to a representative output transducer 28*i*. Transducer 28*i* can be selected from a class which includes horns, bells, sirens, speakers, strobe lights and any other alarm indicating audible or visible output devices.

Module 26*i* includes control circuitry which can be implemented at least in part as a programmed processor 30*a* which is in turn coupled to programmable read-only memory 30*b* and read-write memory 30*c*. A communication link interface 32*a* couples module 26*i* to the communication link 22 and provides bi-directional communication therewith. Processor 30*a* is in turn coupled to an output interface 32*b* which in turn can provide control signals to digital to analog converter 32*c*. Outputs from module 26*i* can include an analog, for example sinusoidal, output on a line 34*a* and/or a binary output, for example a pulse train, on a line 34*b*.

Previously loaded executable control instructions stored in PROM 30*b* can, when executed by processor 30*a*, implement bi-directional communication with a system control unit 29. Module 26*i* can also incorporate executable instructions which enable it to monitor information on the link 22 generated by detectors 24, and/or, by control unit 29.

Figure 3A:
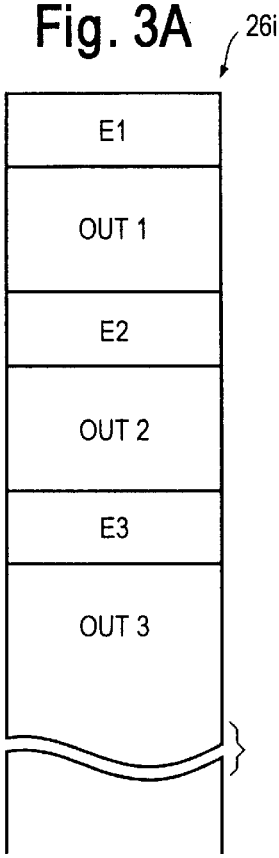
FIGS. 3A, B, C are memory maps illustrating various event/output combinations storable in the module of FIG. 3.

Each of the modules 26*i* can incorporate a plurality of event designators and associated audible or visible output definitions best seen in FIG. 3A. For example, event E1 has associated therewith output 1. Event E2 has associated therewith output 2 and Event E3 has associated therewith output 3. The pre-stored outputs correspond to one or more output defining parameters. In response to appropriate received information, via link 22, from either unit 29 or one or more of detectors 24 or other modules 26, the respective module 26*i* can produce a pre-loaded output sequence on one of lines 34*a, b*.

Event designators and output definitions can be downloaded from system control unit 29 via link 22 to the modules 26 providing flexible, dynamically changeable control over the types of audible or visible outputs associated with various events for a respective module. Hence, different substantially identical modules can be assigned different event/output combinations. Further these assignments can be dynamically modified by system control unit 29. Thus, if some of the transducers 28 are implemented as piezo-electric horns, for example, each such transducer can be driven by a respective module, in response to detection of a predetermined event, based solely on pre-stored event/output combinations as illustrated in FIG. 3A. Similar comments apply to driving visual output devices. It will be understood that a variety of event/output storage configurations could be used without departing from the spirit and scope of the present invention. Alternately, event designators and/or output sequence definitions can be locally entered, via input port 32*c*, using a portable wireless programming unit.

Figure 4A:
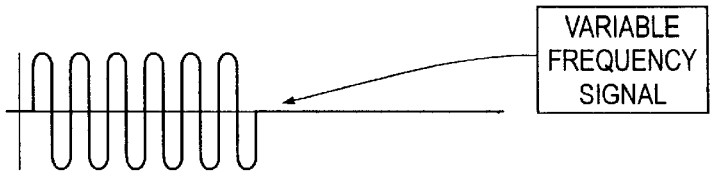
FIGS. 4A–4F are graphs illustrating various exemplary outputs producible by the module of FIG. 3.

Graphs 4A–4F illustrate the output flexibility available by being able to download event/output parameters to the modules 26. FIG. 4A illustrates a variable frequency tonal signal which could be output via a speaker. Different frequencies can be specified and stored in the respective module, in combination with pre-selected events, to produce different constant amplitude, variable frequency signals. Alternately, in addition to frequency variations, amplitude variations could be implemented in a similar fashion.

Figure 4B:
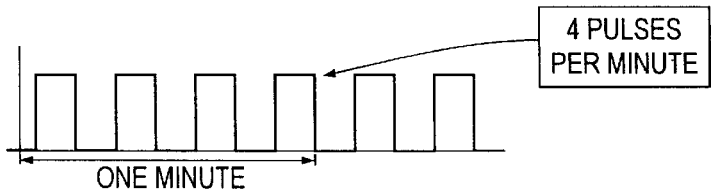

The graph of FIG. 4B illustrates a pulsed output used, for example, to drive an audible sounder such as a horn or a strobe light. Output pulses per minute can be stored at the respective output module 26*i* which in turn will produce, when activated, pulses of a selected frequency, or period. Alternately, duty cycle can be stored as yet another output varying parameter. The output of FIG. 4B can be used to drive a horn of a type that produces a fixed tonal output which is in turn modulated by the on/off signals of FIG. 4B.

Figure 4C:
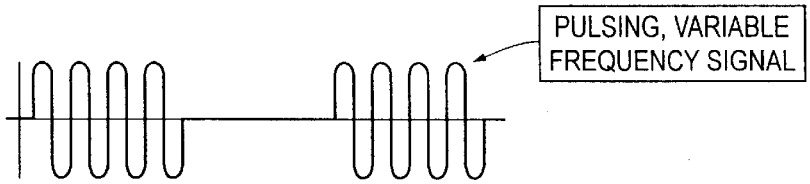

The graph of FIG. 4C illustrates intermittent sinusoidal signals having storable frequencies as well as duty cycles.

The output signals of FIG. 4C can be used to intermittently drive a speaker.

Figure 4D:
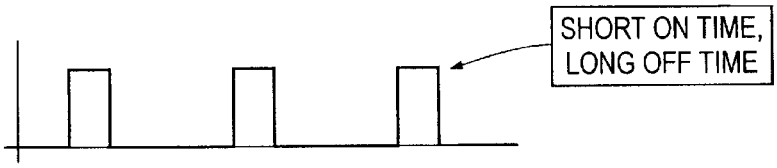
Figure 4E:
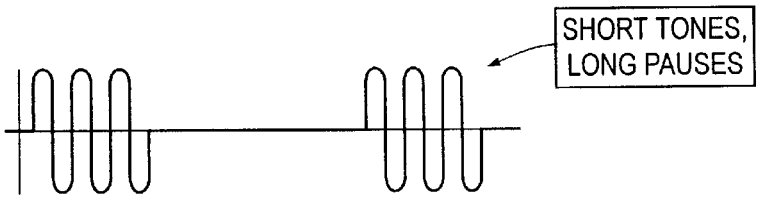

The output signal of the graph of FIG. 4D illustrates an output signal having a variable on-time followed by a variable off-time which can be used to convey a variety of different conditions. FIG. 4E illustrates an intermittent output signal which can be generated by a module such as 26*i* based on stored frequencies, stored on-times and stored off-times. The output signal of FIG. 4E could be used to drive a speaker.

Figure 4F:
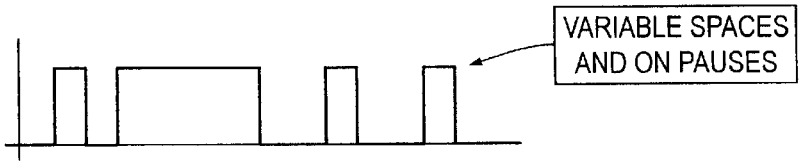

The output signal of FIG. 4F illustrates the use of non-uniform on-times implemented with a mix of longer periods and shorter periods with various selectable duty cycles.

Figure 5:
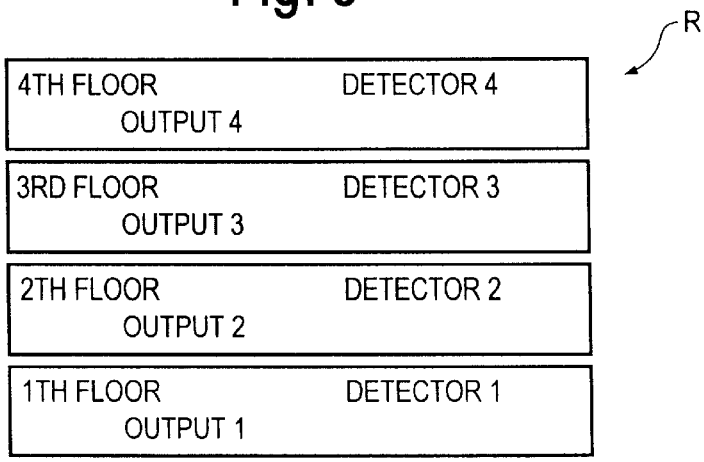
FIG. 5 is an exemplary region being monitored with an alarm system of the type illustrated in FIG. 2.

FIG. 5 illustrates a portion of the system 20 installed in an exemplary region R having four floors. Each of the floors is monitored by a member of the plurality of detectors 24 designated as detector 1, 2, 3, and 4.

An output transducer driven by a respective module is located on each of the floors and designated as output 1, output 2, output 3 and output 4. By way of example, each of the output modules 26*i* can be programmed for three possible event modes, off, alert and evacuation.

Each of the active states, alert and evacuation of the respective module has associated therewith a pre-stored output event as for example illustrated in FIG. 3A. An alert event can be used to produce a relatively slow 20-pulse per minute output tone indicating the presence of a danger condition. An alarm condition which would require an evacuation can be indicated with a faster 60-pulse per minute tone. Corresponding visual signals, of an appropriate rate, could also be produced.

Figure 3B:
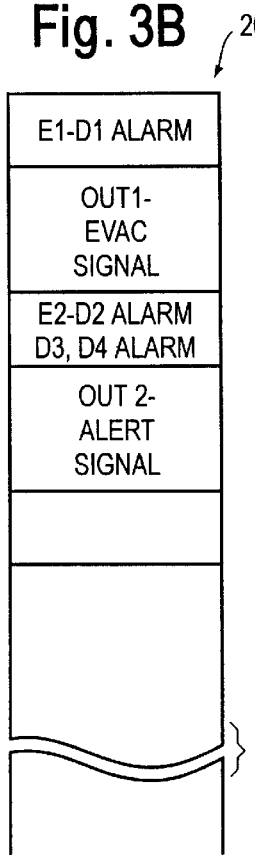

Event information stored in each respective module, such as the module 26*i*, can be associated with signals from a given one of the detectors 1, through 4, and/or a signal from control unit 29. For example, module 26-1 can be programmed with pre-stored events/output information as illustrated in FIG. 3B. Event 1 associated with detector d1 going into alarm produces an output from control module 26-1 and the associated transducer 28-1 of an evacuation signal, such a 60-pulse per minute tone. Event 2 corresponding to any of detectors d2, d3 or d4 going into alarm produces from module 26-1 and transducer 28-1 only an alert tone or alert-type visual output on the first floor.

Figure 3C:
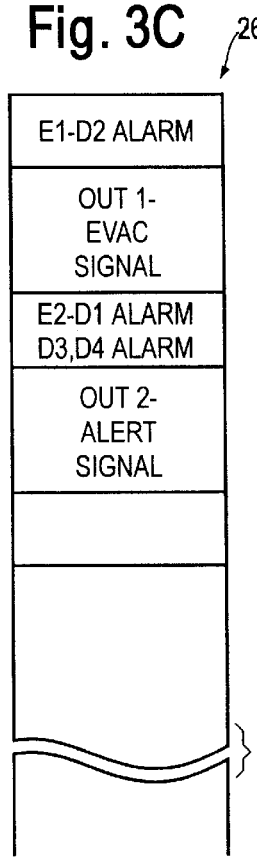

Module 26-2, which is structurally substantially identical to module 26-1, has been loaded with a different event/output sequence as illustrated in FIG. 3C. Module 26-2 incorporates a pre-stored event 1, corresponding to detector 2 going into alarm, in this event, output 1, an evacuation signal, will be produced by transducer 28-2. On the other hand, event 2 corresponding to any of detector d-1, d-3 or d-4 going into alarm will produce an output at transducer 28-2 corresponding to an alarm signal.

Similar sequences can be pre-stored for module 26-3 where event 1 corresponds to detector 3 alarming an event 2 corresponds to detectors 1, 2 or 4 alarming. Similarly, module 26-4 can be loaded with an event/output sequence corresponding to producing an evacuation signal if detector 4 alarms and an alert signal if any of detectors 1, 2, or 3 alarm.

Those of skill will understand that other variations and combinations are possible, depending on the region or regions being monitored as well as the arrangement and number of floors therein. All such variations come within the spirit and scope of the present invention.

For example, the system 10 could be implemented with at least two modules 26*a*, 26*b* and respective output transducers 28*a*, 28*b*. In this instance, each module, such as 26*a* could include storage circuitry, such as ROM, RAM or EEPROM. The storage circuitry can be pre-loaded with definitional information, such as parameters, for at least two different, predetermined, audible or visible output sequences.

Each of the modules could include interface circuitry coupled to control circuitry and the storage circuitry. The interface circuitry 32*a* can in turn be coupled to the communications link 22. The modules can at least receive messages from the devices such as detectors 24, control unit 29 or other modules 26*i*.

The control circuitry 30*a* could be implemented as a programmed processor. In response to one or more received output specifying messages from at least one of the other devices 24, 26 or 29, the control circuitry can output, from local storage, the specified audible or visible output sequence.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An alarm output apparatus comprising:

control circuitry which includes alterable storage for a plurality of output sequence specifiers;

an input port, coupled to the control circuitry, for receipt of a plurality of output sequence specifiers from a displaced source wherein received output sequence specifiers are loaded into storage;

an output port coupled to the control circuitry for outputting control signals to at least one of an audible and a visible output device; and wherein the control circuitry, in response to at least one selected, received condition identifier couples signals to the output port as specified by a respective pre-stored output sequence specifier, for control of the output device.

2. An apparatus as in claim 1 wherein the control circuitry includes a plurality of executable instructions for receiving output sequence specifiers from the input port and storing same.

3. An apparatus as in claim 2 which includes executable instructions for generating control signals for the output port.

4. An apparatus as in claim 1 which includes at least one of, an audio output device and a visual output device, coupled to the output port.

5. An apparatus as in claim 1 which includes pre-stored output specifying sequences specifying first and second pre-defined alarm outputs and executable instructions for producing one of the outputs in response to a received condition identifying input signal.

6. An apparatus as in claim 1 wherein the control circuitry includes a programmed processor and executable instructions for responding to a received condition identifying signal which specifies a pre-stored output and for generating signals for the output port in accordance with the specified output.

7. An apparatus as in claim 6 wherein the output device is selected from a class which includes horns, bells, sirens, speakers and visual alarm indicators.

8. An apparatus as in claim 1 which includes a wired medium coupled to the input port with at least one ambient condition detector coupled thereto.

9. An apparatus as in claim 8 wherein the control circuitry is responsive to first and second different identifiers received at the input port, via the link, and includes circuitry for selecting a respective pre-stored, output sequence specifier from a plurality of output sequence specifiers.

10. An alarm system comprising:

a communications link;

a plurality of control modules, coupled to the link; wherein each module includes storage circuitry which can receive and store definitions of a plurality of audible outputs from the link wherein each module includes storage for condition activating information, associated with respective ones of the outputs; and, executable control instructions for receiving condition indicating information from the link, determining a respective audible output and outputting same.

11. An alarm system as in claim 10 which includes a common control element, coupled to the link, wherein the control element includes executable instructions for downloading definitions of audible output patterns to at least some of that control modules.

12. An alarm system as in claim 11 which includes a plurality of ambient condition detectors, coupled to the link, wherein the detectors transmit local condition information via the link.

13. An alarm system as in claim 12 wherein at least some of the control modules include executable instructions for monitoring information transmitted via the link and for responding to at least some of that information.

14. An alarm system as in claim 13 wherein at least some of the control modules include executable instructions for responding to received condition information and for producing a respective audible output from a plurality of pre-stored audible output patterns.

15. A method comprising:

monitoring selected ambient conditions in a plurality of spaced-apart regions;

providing a plurality of alarm indicating output devices in respective of the regions wherein each of the output devices is drivable via a respective single input port to produce a plurality of different alarm indicating outputs in response to input signals from a class which includes analog drive signals, and binary pulse trains;

transmitting condition related information throughout the regions;

monitoring the transmitted information at the output devices, and, in response to selected, monitored information, executing a plurality of instructions in at least some of the output devices in some of the regions thereby generating a selected one of the analog drive signals and binary pulse trains and in response thereto, producing one of a plurality of predefined alarm indicating outputs, in each of the respective regions wherein outputs are variable by region in response to instructions executable at the respective output device.

16. A method as in claim 15 wherein the producing step includes producing at least one of an audible output and a visible output.

17. A method as in claim 15 which includes pre-storing information for specifying a plurality of different outputs in each of some of the output devices.

18. A method as in claim 17 wherein at least some of the information specifies different audible outputs.

19. A method as in claim 18 which includes driving selected audio output devices in accordance with selected portions of the prestored information.

20. An alarm system having at least two output devices coupled to a communications link, the output devices comprising:

storage circuitry containing at least two different, predetermined, output sequences;

input circuitry coupled to the communications link for receiving messages transmitted from other devices coupled to the communications link;

control circuitry for selecting an output sequence from the predetermined output sequences according to the received messages from other devices; and output circuitry for outputting the selected output sequence audibly or visually.

21. An alarm system as in claim 20 wherein the storage circuitry comprises at least one of ROM, RAM, or EEPROM type memory.

22. An alarm system as in claim 20 wherein the control circuitry comprises a programmed processor.

23. An alarm system as in claim 20 wherein the output devices include circuitry to transmit messages on the communications link.

24. An alarm system as in claim 20 wherein the output comprises audible output from a horn that pulses ON and OFF, changes audible level, or changes audible frequency according to the selected output sequence.

25. An alarm system as in claim 20 wherein the output comprises visual output from a visual indicator that pulses ON and OFF, changes light intensity, or changes light frequency according to the selected output sequence.

26. A system comprising:

a bi-directional communication link;

a plurality of devices wherein each of the devices has circuitry that can receive and transmit status identifiers onto the bi-directional communications link;

a programmer unit to download alterable status identifiers and alterable associated audible outputs into at least one device of the plurality of devices;

wherein the at least one device can receive status identifiers transmitted by other devices of the plurality on the bi-directional communication link, compare that received status identifier with the at least one stored status identifier, and execute the associated previously downloaded audible output if a predetermined relationship is determined between the status identifiers.

27. A system as in claim 26 wherein the downloaded alterable status identifiers and alterable associated audible outputs are stored in non-volatile memory in the at least one device.

28. A system as in claim 26 wherein the programmer comprises one of a system control unit coupled to the bi-directional communication link; and a portable handheld programming unit.

29. A system as in claim 26 wherein the programmer is temporarily coupled to the bi-directional communication link in order to download the alterable status identifiers and alterable audible outputs.

30. A system as in claim 26 wherein the programmer downloads the alterable status identifiers and alterable audible outputs by a vehicle other than the bi-directional communication link, wherein the vehicle is selected from a class of electromagnetic waves, optical, electrical, magnetic, or electrical fields.

31. A system as in claim 26 or claim 27 wherein the audible output is a sequence implemented by turning the audible output on and off to form a sound pattern.

32. A system as in claim 31 wherein the sound pattern is repeated.

33. A system as in claim 26 or claim 27 wherein the audible output is changed to an audible output associated with a new received status identifier if the new received status identifier has a greater priority, based on a predetermined priority scale, than the previously received status identifier.

34. A system as in claim 26 or 27 wherein the audible outputs are used to instruct people to carry out predetermined actions such as evacuation.

35. A system as in claim 26 or claim 27 wherein the audible output is associated with received synchronization information wherein all activated devices operate their audible outputs in synchronization.

36. A system as in claim 26 or claim 27 wherein the status identifiers indicate status from a class of individual device alarm and multiple device alarm wherein the alarm type can be fire, security, or gas.

37. A system as in claim 26 or claim 27 wherein the status identifiers contain zone information and the predetermined relationship is that the received status identifiers are the same as the stored status identifiers.

38. A system as in claim 26 or claim 27 wherein the status identifies contain zone information and the predetermined relationship is that the zone information in the received status identifiers is the same as the zone information of the stored status identifiers.

39. A system comprising:

a bidirectional communication link;

a plurality of devices wherein each of the devices has circuitry that can receive and transmit status identifiers onto the bi-directional communications link;

at least one status identifier and associated audible output stored in at least one device of the plurality of devices;

wherein the at least one device can receive status identifiers transmitted by other devices of the plurality via the bi-directional communication link compare that received status identifier with the at least one stored status identifier, and execute the associated audible output if a predetermined relationship is determined between the status identifiers.

* * * * *